US005830111A

United States Patent [19]

Johnston

[11] Patent Number: 5,830,111

[45] **Date of Patent: *Nov. 3, 1998**

[54] MULTISTEP EXERCISE APPARATUS

[76] Inventor: Gary Lawrence Johnston, P.O. Box 183, Cowarts, Ala. 36321

[ * ] Notice: The term of this patent shall not extend beyond the expiration date of Pat. No. 5,505,678.

[21] Appl. No.: 648,367

[22] Filed: May 15, 1996

Related U.S. Application Data

[63] Continuation-in-part of Ser. No. 215,040, Mar. 21, 1994, Pat. No. 5,505,678, and Ser. No. 513,214, Aug. 9, 1995, Pat. No. 5,520,596.

[51] Int. Cl.[6] ..... A63B 21/02; A63B 23/04

[52] U.S. Cl. ..... 482/52; 482/80

[58] Field of Search ..... 482/51, 52, 53, 482/74, 70, 71, 79, 80

[56] References Cited

U.S. PATENT DOCUMENTS

| | | | |
|---|---|---|---|
| 4,676,501 | 6/1987 | Hoagland | 482/52 |
| 4,842,268 | 6/1989 | Jenkins | 482/52 |
| 4,900,012 | 2/1990 | Fu | 482/52 |
| 5,490,818 | 2/1996 | Haber et al. | 482/52 |
| 5,505,678 | 4/1996 | Johnston | 482/52 |
| 5,536,225 | 7/1996 | Neuberg et al. | 482/52 |
| 5,569,127 | 10/1996 | Johnston | 482/52 |

*Primary Examiner*—Stephen R. Crow

[57] ABSTRACT

A lever operated exercise apparatus in which a user operates while in a standing position. The apparatus includes a foot engagement assembly mounted on a frame structure and comprises two foot members coupled to the frame which move in a substantially vertical direction. A power translating mechanism comprising a lever operatively connects the frame structure and the foot engaging assembly such that a downward force by one foot member produces an upward force in the other foot member.

17 Claims, 10 Drawing Sheets

MULTISTEP EXERCISE APPARATUS

BACKGROUND OF THE INVENTION

1. Cross Reference to Related Applications

This application is a continuation-in-part of U.S. application Ser. No. 08/215,040 entitled "Side Stepping Exercise Apparatus", filed on Mar. 21, 1994, U.S. Pat. No. 5,505,678 entitled "Lever Operated Exercise Apparatus", issued on Apr. 9, 1996, and U.S. application Ser. No. 08/513,214 entitled "Stepping Exercise Apparatus", filed on Aug. 9, 1995, now U.S. Pat. No. 5,520,596.

2. Field of the Invention

This invention relates to a lower body exercise device and in particular to an exercise device upon which the user, while in a standing position, pushes downward upon one side of the device with their foot, causing this side of the device to move downward. This downward motion causes the opposite side of the device, which supports the opposite foot, to move upward in a substantially vertical direction. Both feet of the user remain in a substantially horizontal position. The user may then push downward upon the raised side of the device, thereby producing upward movement in the other side of the device, and thus the other foot. This action is repeated back and forth to provide a stepping type of exercise routine not found in any current type of lower body exercise products.

3. Description of the Prior Art

Presently there exists many variations of lower body exercise devices which perform a type of stepping motion. These include stair-stepper machines and treadmills. While these units offer relatively good lower body exercise routines, they appear to be one dimensional. Stair-stepper machines usually have a foot rest member pivotally mounted to a frame, with the user having to step downward at an angle to perform the desired exercise routine. The motion of the user is therefore at an angle, not in a true upward and downward direction. Some stair-stepping devices do have foot rest members which move with the position of the feet, but the feet do not necessarily maintain a substantially horizontal position at all times, and do not move in a substantially vertical direction. Treadmills only offer a type of walking or jogging step motion, in which the user feels resistance when their foot contacts the belt surface. In addition, there is also prior patented art which show stepping exercise products which utilize a foot rest member. Unlike stair-steppers, the foot rest members move along a guided path, and are not pivotally connected to the frame. These include the following:

U.S. Pat. No. 4,842,268 to Jenkins demonstrates an exercise device having foot rest members which move in opposite upward and downward directions through a belt and pulley type of power translating mechanism. Each foot rest member is supported at its proximate center by a support member which extends from one side to the other. The foot rest member is mounted to a guide means located along its side.

U.S. Pat. No. 4,958,830 to Huggins et al. demonstrates an exercise device having foot rest member moving in opposite upward and downward direction, slightly angled, through a combined chain, sprocket, and lever type of power translating mechanism. Each foot rest member is supported at its proximate center by a support member which extends from one side to the other. The foot rest member is mounted to a guide means located along its side.

U.S. Pat. No. 5,199,932 to Liao demonstrates an exercise device having foot rest members moving in opposite upward and downward directions, slightly angled, through a hydraulic type of power translating mechanism. Each foot rest member is supported at its proximated center by a support member which extends from one side to the other. The foot rest member is mounted to a guide means located along its side.

G. B. Patent No. 2,010,101 to Hickman demonstrates an exercise device having foot rest members moving in opposite upward and downward directions, along an angle, through a roller and strap type of power translating mechanism. Each foot rest member is supported and guided along both sides.

U.S. Pat. No. 4,676,501 to Hoagland et al. demonstrates an exercise device having foot rest members moving in opposite upward and downward directions through an electric motor and lever type of power translating mechanism. Each foot rest member is supported and guided along both sides.

U.S. Pat. No. 4,900,012 to Fu demonstrates an exercise device having foot rest members moving independently in the upward and downward directions, utilizing a spring type of power translating mechanism. Each foot rest member is supported along both sides.

U.S. Pat. No. 5,267,922 to Robinson demonstrates an exercise device having foot rest members moving in opposite upward and downward directions, at an angle, through a pulley and cable type of power translating mechanism. Each foot rest member is supported and guided along its front end.

U.S. Pat. No. 2,079,594 to Clem demonstrates an exercise device having foot rest members moving in opposite upward and downward directions through a hydraulic type of power translating mechanism. Each foot rest member is supported and guided along its front end.

U.S. Pat. No. 4,786,050 to Geschwender demonstrates an exercise device having foot rest members moving in opposite circular motion, slightly slanted, through a pulley, belt, and lever type of power translating mechanism. Each foot rest member is supported and guided at the front and rear of one side.

U.S. Pat. No. 1,990,124 to Kabisius demonstrates an exercise device having foot rest members pivotally mounted at one end to a frame and to a mechanical crank and lever type system. Each foot rest member is supported and guided at one end.

U.S. Pat. No. 4,720,093 to Del Mar demonstrates an exercise device having foot rest members pivotally mounted at one end to a frame and to a chain and sprocket type system. Each foot rest member is also supported and guided by a double lever system which keeps the foot rest members horizontal. Each foot rest members move independent of one another, with upward movement in the members being produced by a set of springs.

None of the above inventions and patents, taken either singly or in combination, is seen to describe the instant invention as claimed. Jenkins, Huggins, Robinson, Del Mar, and Geschwender all demonstrate power translating mechanisms which utilize a type of pulley and belt system. Higgins and Geschwender do include lever means, but they are used very differently from the lever means in the invention. Liao and Clem utilize a type of hydraulic or pneumatic power translating mechanism. Fu and Del Mar demonstrates a type of exercise device using springs to produce upward movement of the foot rest members. Kabisius utilizes a type of power translating mechanism comprised basically of a crank system, with one crank link being a type of lever. However, this invention is much different from the one described and claimed in the specification. Hoagland does demonstrate a type of power translating mechanism which uses levers to transmit power. However, these forces are transmitted from a motor means to each foot rest member, not from one foot rest member to the other.

This new exercise device offers a new type of stepping exercise in which forces continuously act against the user in the substantially vertical direction. The user pushes downward upon a first member which is moveably coupled to a device frame. A second foot rest member is also moveably coupled to the device frame. In one version, a lever means is pivotally mounted at its proximate center to the device frame. One end of the lever means is connected to the first foot rest member while the other end is connected to the second foot rest member. As the user steps downward upon one foot rest member, the other foot rest member moves upward. In a second version, a pulley means and a tether means is used to connect the foot rest members. Given the fact that there are vast numbers of exercise devices on the market today, it has come as a surprise that no one has effectively designed a device upon which a user may perform this type of stepping exercise routine, utilizing a lever means in this manner for power translation.

SUMMARY AND OBJECTS OF THE INVENTION

It is the object of this invention to provide a stepping device which is comfortable, easy, and safe to operate while in a standing position. One version may allow for manual operation of the device, with the upward and downward stepping motion being induced by the user. A second version of the device may allow for automatic operation of the device whereby the upward and downward stepping motion is induced by a motor. Both of these features will offer a better and more versatile workout than found on current stepper and treadmill type exercise products.

It is the further object of this invention to provide a lower body exercise device which may include a handle member for use in maintaining proper balance. The handle may also be used in conjunction with the feet to operate the device, thereby allowing the user to exercise both upper and lower body muscle groups. The handle member may also be adjustable to compensate for various user heigths.

Briefly stated, the apparatus that forms the basis of the present invention comprises basically a structural frame means, a foot engagment means, and a power translating mechanism. The power translating mechanism comprises an optional shaft means and at least one lever means. A second type of power translating mechanism may include a pulley means and a tether means. The device may also include a hand engagement means which may be used for balancing purposes, or may be used in conjunction with the foot engagment means for operating the device. The device may include a resistance means which may operate in conjunction with the power translating mechanism. This would be for manual operation of the device. Another version of the device may include a motor means for automatic operation.

The structural frame means may include support members which form a strong support base. The foot engagement means and the power translating mechanism mount upon this frame. The hand engagement means may also mount upon the frame or may mount upon the foot engagement means, whichever is preferred.

As stated previously, a resistance means may be included for manual operation of the device. It may mount as a separate component on the frame and connect to the power translating mechanism. It would operate in conjunction with the foot engagment means to provide a force against the user during the stepping motion. The amount of resistance may be adjustable to provide the desired resistance force. Instead of a resistance means, a motor means may mount as a separate component upon the frame and connect to the power translating mechanism for automatic operation of the device. The stepping motion of the device would be induced by the motor, not the user.

Also if an optional hand engagement means is to be used, it may be upward and downward adjustable to compensate for different user heigths. As previously stated, the hand engagement means may be connected to the frame and used for balancing purposes, or it may be connected to the foot engagement means and used for upper body workout routines.

A conventional exercise computer may also be part of the apparatus. It will not be shown in the accompanying figures, but may connect to the foot engagement means or to the power translating mechanism, and keep track of exercise related data such as number of steps, time, etc.

Other objects, features, and advantages for this invention will be apparent from the following detailed description and the appended claims, references being made to the accompanying drawings forming a part of the specification, wherein like reference numerals designate corresponding parts of several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
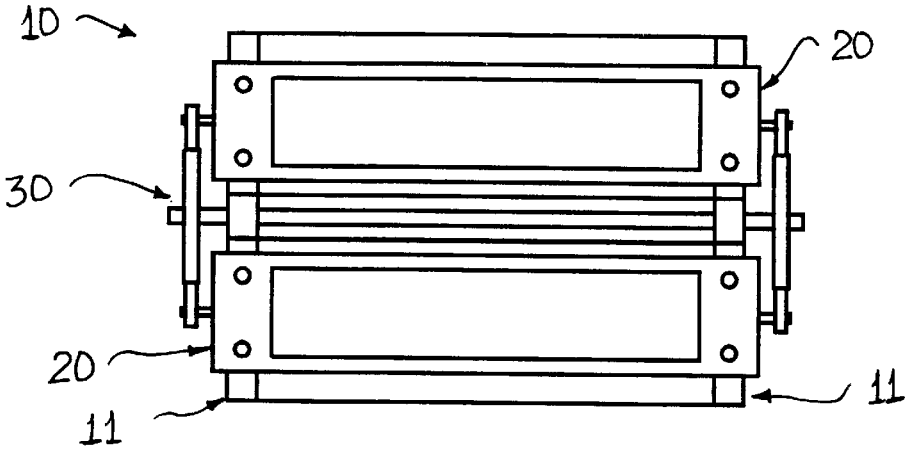
FIG. 1A is a top view of the multistep exercise apparatus.
Figure 1B:
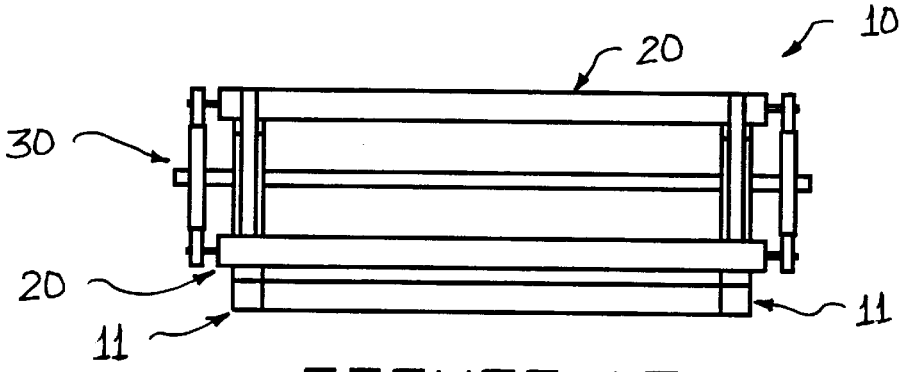
FIG. 1B is a side view of the multistep exercise apparatus.
Figure 1C:
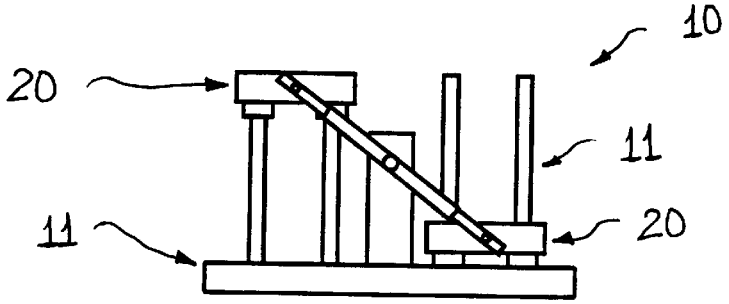
FIG. 1C is a front view of the multistep exercise apparatus.

As best can be seen by references to the drawings, and in particular to FIGS. 1A, 1B, and 1C, the stepping exercise apparatus that forms the basis of the present invention is designated by the reference numeral 10. Stepping exercise apparatus 10 basically comprises a structural frame means 11, a foot engagement means 20, and a power translating mechanism 30.

Figure 2A:
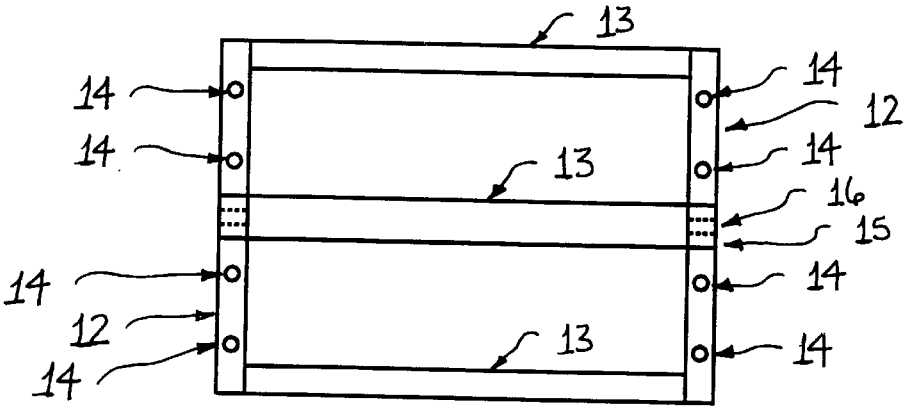
FIG. 2A is a top view of the structural frame means of the multistep exercise apparatus.
Figure 2B:
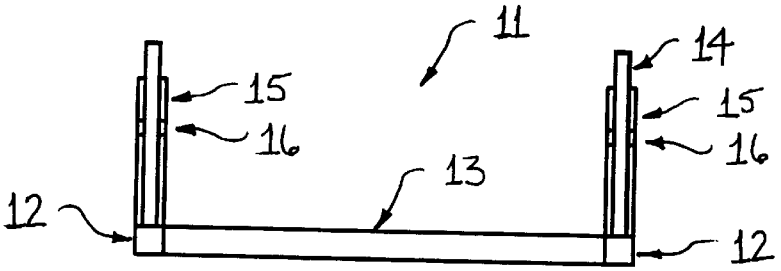
FIG. 2B is a side view of the structural frame means of the multistep exercise apparatus.
Figure 2C:
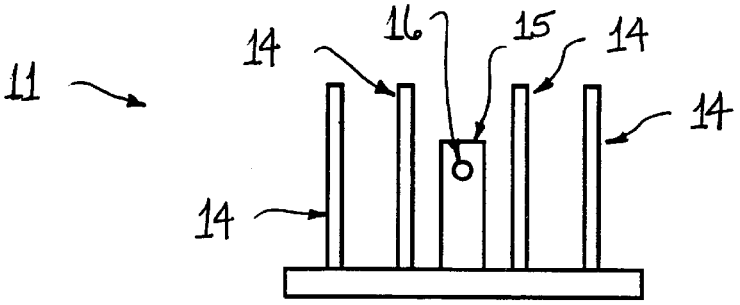
FIG. 2C is a front view of the structural frame means of the multistep exercise apparatus.

Referring to FIGS. 2A, 2B, and 2C, structural frame means 11 comprises base support members 12, cross members 13, guide members 14, and mechanism mounts 15. Base support members 12 are elongated support structures used to support guide members 14 and mechanism mounts 15. Cross members 13 are also elongated support structures which are used to connect the base support members 12. These create a more sturdy structure. Guide members 14 are mounted on base support members 12 and are upwardly extending support elements used to guide the foot engagement means 20 in a substantially vertical direction. The mechanism mounts 15 are used to support the various components of power translating mechanism 30, and they mount upon base support members 12. Each mechanism mount 15 may contain a mount opening 16 through which the power translating mechanism 30 may mount.

Figure 3A:
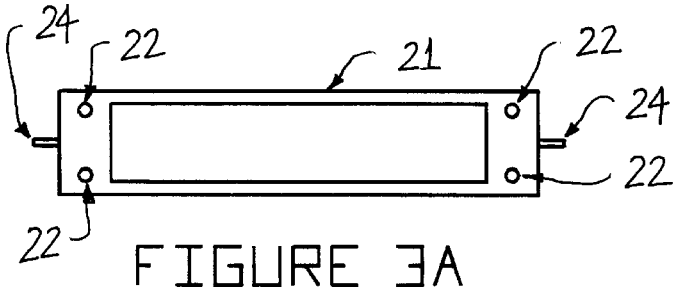
FIG. 3A is a top view of the foot engagement means of the multistep exercise apparatus.
Figure 3B:
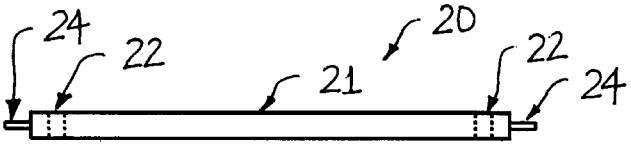
FIG. 3B is a side view of the foot engagement means of the multistep exercise apparatus.
Figure 3C:
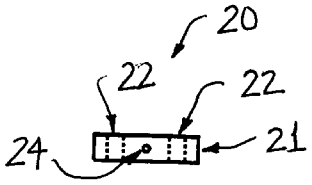
FIG. 3C is a front view of the foot engagement means of the multistep exercise apparatus.

As may be seen in FIG. 3A, 3B, and 3C, the foot engagement means 20 comprises foot engaging members 21, which are relatively flat structures upon which the user places their feet. Each foot engaging member 21 contains guide openings 22 which receive guide members 14 of structural frame means 11. Foot engaging members 21 also have rod-like foot member connectors 24 extending outward from each end. These are used to connect the foot engaging members 21 with the power translating mechanism 30.

Figure 4A:
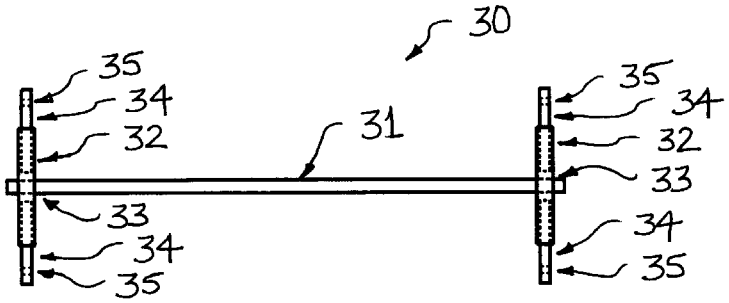
FIG. 4A is top view of the power translating mechanism of the multistep exercise apparatus.
Figure 4B:
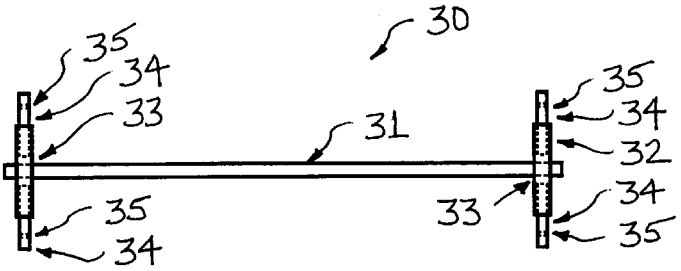
FIG. 4B is side view of the power translating mechanism of the multistep exercise apparatus.
Figure 4C:
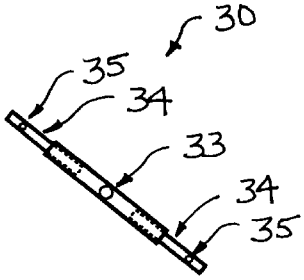
FIG. 4C is front view of the power translating mechanism of the multistep exercise apparatus.

Shown in FIGS. 4A, 4B, and 4C are the various components of one type of power translating mechanism 30. These include an optional shaft means comprised of at least one shaft member 31, and a lever means comprising lever connection member 32 having lever connection opening 33, sliding connector 34, and sliding connector opening 35. If optional shaft member 31 is utilized, it will turnably mount through mount opening 16 of mechanism mount 15, and extend from the front of the structural frame means 11 to the rear. Lever connection member 32 would thus rigidly mount on shaft member 31, one at each end, or one at the proximate center. If a shaft member 31 is not utilized, the lever connection member 32 could mount to mechanism mount 15 through some type of bolt means, which would also allow the lever to pivot with respect to the frame. Preferrably, a shaft member would be utilized. The lever means serves as a force transmitting means.

Figure 5A:
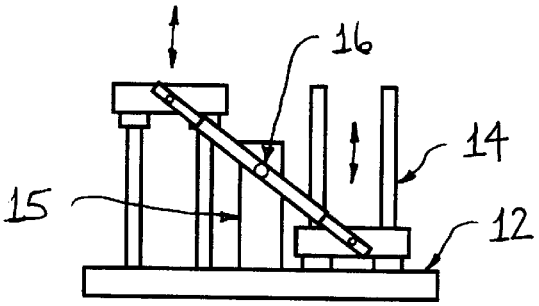
FIG. 5A is a front view of the multistep exercise apparatus demonstrating one of the operating positions of the apparatus.
Figure 5B:
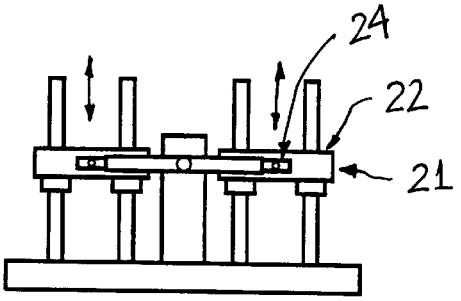
FIG. 5B is another front view of the multistep exercise apparatus demonstrating another operating position of the apparatus.
Figure 5C:
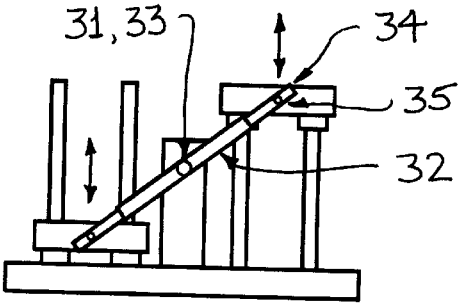
FIG. 5C is another front view of the multistep exercise apparatus demonstrating another operating position of the apparatus.

FIGS. 5A, 5B, and 5C demonstrate from the front view the operation of the stepping exercise apparatus. Shown are various operating positions of the foot engagement means 20 and the power translating mechanism 30. The other side of the apparatus may be configured similarly. As seen, foot engaging members 21 will slide in upward and downward directions along guide members 14. Guide bearings, which may be a type of sliding, rolling, or ball bearing, may be placed in guide openings 22 to assist with the sliding motion. At least one guide member 14 should be coupled to each end of the foot engaging member 21 to keep the member in a substantially horizontal position as it moves upward and downward. The drawings demonstrate two guide members 14 at each end, and this will probably prove to provide better guidance than one, although one guide member 14 at each end may still work.

As seen in FIGS. 5A through 5C, when a shaft member 31 is utilized, the foot engaging members 21 are connected to it through lever connection member 32. Lever connection member 32 may be rigidly mounted to shaft member 31 through lever connection opening 33 by a weld or bolt. Shaft member 31 is turnably mounted to mechanism mount 15 through mount opening 16. A shaft bearing, such as a bushing or ball bearing, may be placed within mount opening 16 to allow easier turning. If a shaft member 31 is not utilized, the lever connection member 32 may pivotally mount upon a fixed axle located on the structural frame means 11. As seen, lever connection member 32 has a separate sliding connector 34 extending outward on each side, which is able to slide inward and outward. Each end of the sliding connector 34 is loosely connected to the foot member connector 24 of foot engagement means 20 through lever connection opening 33. Therefore, downward motion of one foot engaging member 21 will produce partial rotation in lever connection member 32. Because the two foot engaging members 21 are located on opposite sides of the lever connection member 32, upward motion in one foot engaging member 21 will cause downward motion in the second foot engaging member 21, and vice versa. The main purpose of the shaft member is to allow a more balanced transfer of power between foot engaging members 21, and also allow a more balanced transfer of power between the members and a resistance means 40 or a motor means 50. This is explained in greater detail in U.S. application Ser. No. 08/215,040.

In the situation described above, guide members 14 are used to keep the foot engaging members 21 from twisting in the side directions when forces are not applied to the members at the center of gravity. This is also explained in greater detail in U.S application Ser. No. 08/215,040. In a lever type system, the lever(s) keeps the foot engaging members 21 from twisting in the forward and backward directions. Different lever configurations may be used to also prohibit twist in the side direction. As may be seen in FIG. 5D, it may prove desireable to have an additional lever with additional sliding connectors, 34A and 34B. The additional lever may be located either above, below, or to the side of the other. If the additional lever is rigidly connected to the first lever, then the additional connectional points would have to be either above or below the original connection points. If not, the additional connection points could be located to the side.

One additional connector is all that would be required, provided each end of the apparatus has a lever with a sliding connector 34 connected to the opposite foot engaging member 21. It will probably prove best to utilize two. They loosely connect to two foot member connectors, 24A and 24B, of foot engagement means 20, which are in approximately alignment. The use of an additional lever will thus allow easier movement of the foot engaging members in the upward and downward directions, since the guide members 14 would no longer feel resistance. As stated earlier, one lever located at the proximate center of the shaft member and connecting the proximate centers of the foot engaging members 21 would also work. In that instance, two sliding connectors would be required. However, it would probably prove best to have at least one additional sliding connect 34A, added to additional levers rigidly mounted to the first levers near the front and rear of the apparatus.

Figure 5D:
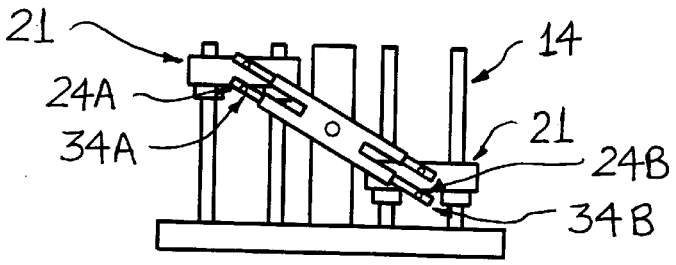
FIG. 5D is a front view of the multistep exercise apparatus demonstrating a double lever type of power translating mechanism.
Figure 5E:
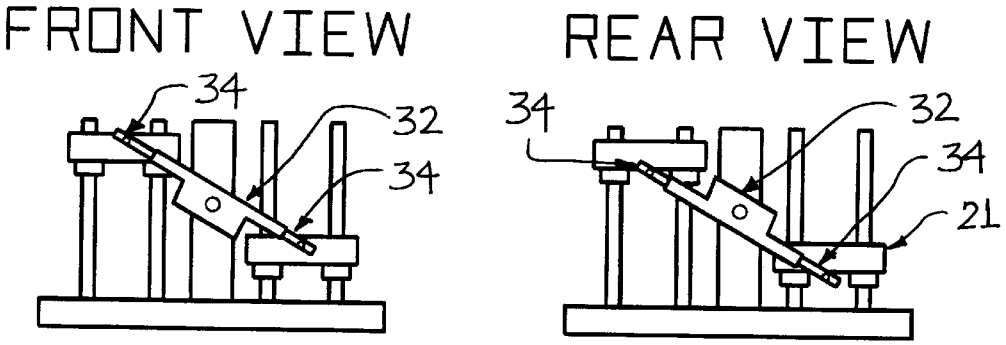
FIG. 5E is a front and rear view of the multistep exercise apparatus demonstrating a single lever type of power translating mechanism, a lever being connected to the foot engagement means at each end, and at different connection point locations.

FIG. 5E demonstrate how a single lever located at each end of the apparatus can also be used to prohibit twist in the side directions. As seen, if the lever connection members 32 located at each end of the apparatus are connected by sliding connectors 34 to the foot engaging members 21 at different connection point coordinates, this would also keep the foot engaging members from twisting in the side directions. This serves the same purpose as having additional lever connector members 32 having additional sliding connectors 34A and/or 34B. The different connection point coordinates may have a different vertical coordinate, a different horizontal coordinate, or both. As seen in FIGS. 5D and 5E, when a lever is used to prohibit twist in the side directions, the location of the guide members does not have to be at the front and rear of the apparatus. The guide member could be located to the side of the foot engaging members. However, locating the guide members near the front and rear of the apparatus may prove best.

A desireable feature of the foot engaging members 21 is that they have sufficient length for allowing the user to perform forward and backward stepping routines. The user would place one foot towards the front of the apparatus, and the other foot towards the rear. This ability to perform forward and backward stepping routines is what separates this device from other similar products.

Figure 5F:
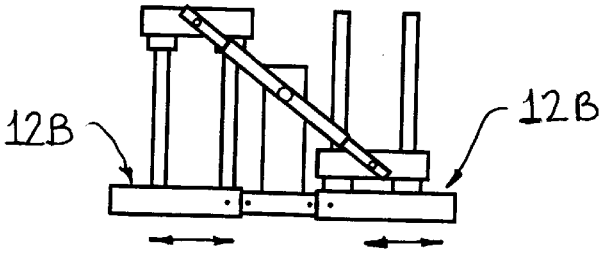
FIG. 5F is a front view demonstrating a multistep exercise apparatus with an adjustable structural frame means which may be adjusted for a wider operating stance.
Figure 5G:
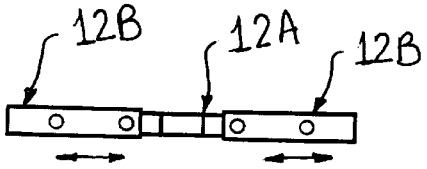
FIG. 5G is a top view demonstarting a multistep exercise apparatus with an adjustable structural frame means which may be adjusted for a wider operating stance.

FIGS. 5F and 5G demonstrate a method of varying the stance of the user, which would provide a more flexible workout. Base support members 12 may now be composed of two components, 12A and 12B. Component 12B supports the guide members 14 and may be positioned along component 12A at different intervals. Both components 12A and 12B have holes 28 through the sides. These holes may be aligned, and the components secured together through some type of securing means such as a pin or bolt. The sliding connectors 34 of the power translating mechanism 30 will slide within the lever connection member 32 and adjust itself accordingly. By having the capability to vary the stance width, the flexibility of the apparatus is greatly increased.

Figure 5H:
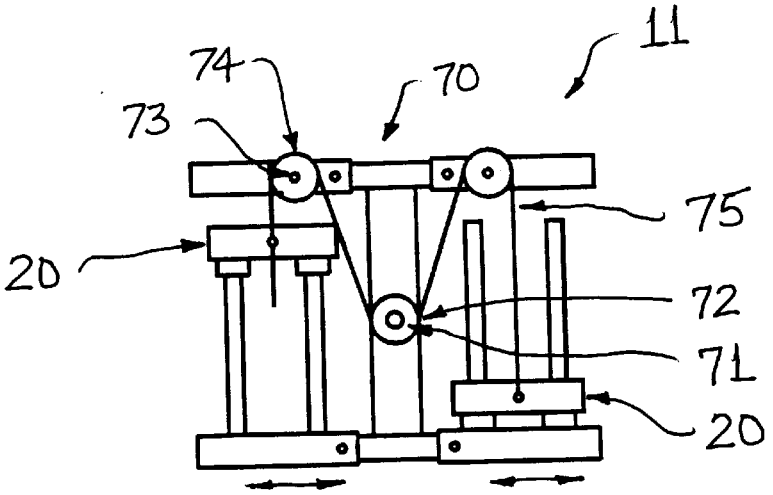
FIG. 5H is a front view of a second type of power translating mechanism for the multistep exercise apparatus.
Figure 5I:
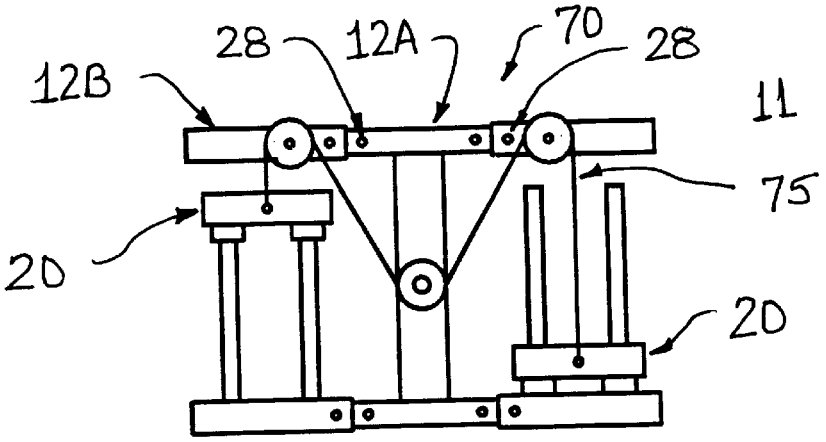
FIG. 5I is a front view of a second type of power translating mechanism for the multistep exercise apparatus, demonstrating an adjustable structural frame means.

FIGS. 5H and 5I demonstrate a multistep exercise apparatus having a second type of power translating mechanims 70, along with an adjustable structural frame means 11. As may be seen in FIG. 5H, this type of mechanism includes shaft member 71 with shaft mounted rotatable members 72, and a force transmitting means comprising axle members 73, mechanism mounted rotatable members 74, and tether means 75. A tether means 75, such as a belt, cable, chain, etc., is used to connect the mechanism mounted rotatable members 74 with the foot engagement members 20, and to shaft mounted rotatable member 72, if a shaft is utilized. Mechanism mounted rotatable members 34 may be rigidly mounted upon axle members 73, which may be rotatably mounted to structural frame means 11. If a shaft member 71 is to be utilzed, it will rotatably mount to structural frame means 11, and shaft mounted rotatable member 72 would thus rigidly mount on shaft member 71, one at each end, each in the proximate same plane as the corresponding mechanism mounted rotatable members 74. If a shaft member 71 is not utilized, then tether means 75 connects only mechanism mounted rotatable members 74 with foot engagement members 20.

As may be seen in FIG. 5I, the structural frame means 11 may be adjusted so that the user may vary their width of stance. As again may be seen, base support members 12 of structural frame means 11 may be composed of two components, 12A and 12B. Component 12B supports the guide members 14 and mechanism mounted rotatable members 74, and may be positioned along component 12A at different intervals. Both components 12A and 12B have holes 28 through the sides. These holes may be aligned, and the components secured together through some type of securing means such as a pin or bolt. Before the frame may be adjusted, the tether means 75 must be disconnected from foot engagement members 20. Once the frame has been adjusted, the tether means 75 will then be reconnected. Tether means 75 must be of sufficient length so that it can be connected and reconnected to foot engagement members 20 at various intervals.

Having a force transmitting means, whether a lever means or a pulley and tether means, located at both the front and rear ends of the structural frame means, and also having them operatively connected together, such as through a shaft means, should prove to provide the most efficient design for the apparatus. The reasoning behind this is explained in greater detail in U.S. application Ser. No. 08/215,040. This design should ensure smoother movement of the foot engaging members, since the movement of the front portion of the foot engaging member will occurr simultaneous with movement in the rear portion of the foot engagement member, and vice versa. It would be also possible to have a separate shaft member associated with each foot engaging member, each shaft member operatively connecting the force transmitting means which act on the front and rear portions of the foot engaging member. In this case, the foot engaging members would operate independent of one another. Upward movement of each foot engaging member could then be accomplished through a set of springs, not the other foot engaging member. This concept may be seen in both U.S. Pat. No. 4,900,012 to Fu, and U.S. Pat. No. 4,720,093 to Del Mar. In these cases, the springs serve as force transmitting members. They produce an upward force against the foot engaging members, and thus upward motion in the foot engaging members. For the apparatus described in this specification, one spring could be located at each end of the foot engaging member, and connect the foot engaging member to the structural frame means. The springs would serve as a force transmitting means for moving the foot engaging members in the upward direction. Again, the advantages of having force transmitting means acting upon the foot engaging members at each end have been previously explained, along with the advantages of having the force transmitting means operatively connected together.

Figure 6A:
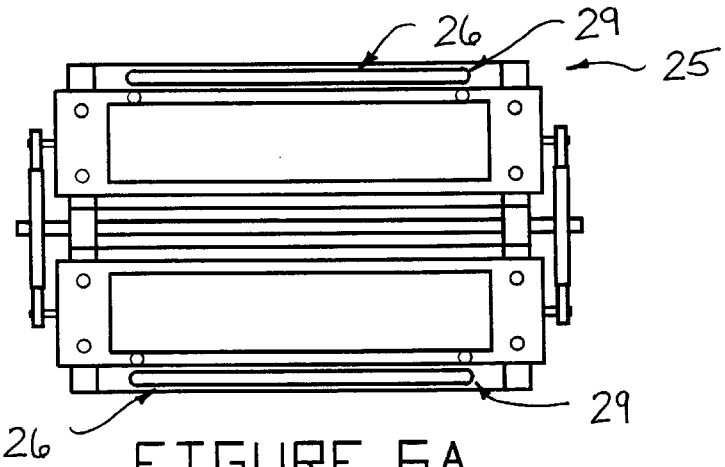
FIG. 6A is a top view of the multistep exercise apparatus utilizing a hand engagement means mounted to the structural frame means.
Figure 6B:
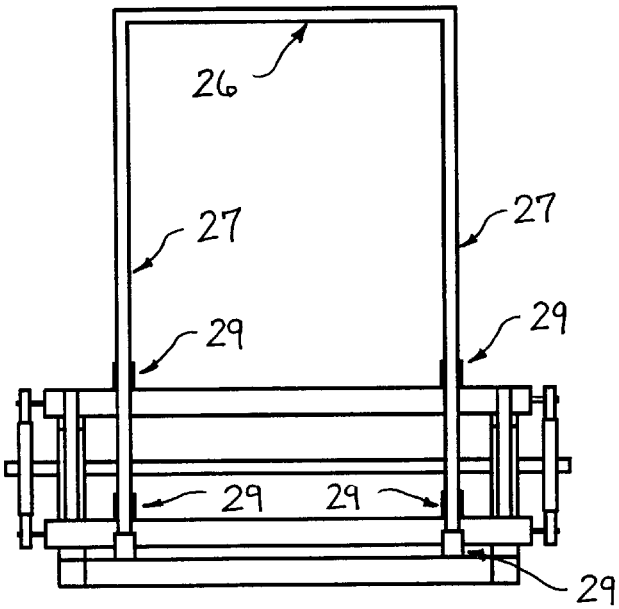
FIG. 6B is a side view of the multistep exercise apparatus utilizing a hand engagement means mounted to the structural frame means.
Figure 6C:
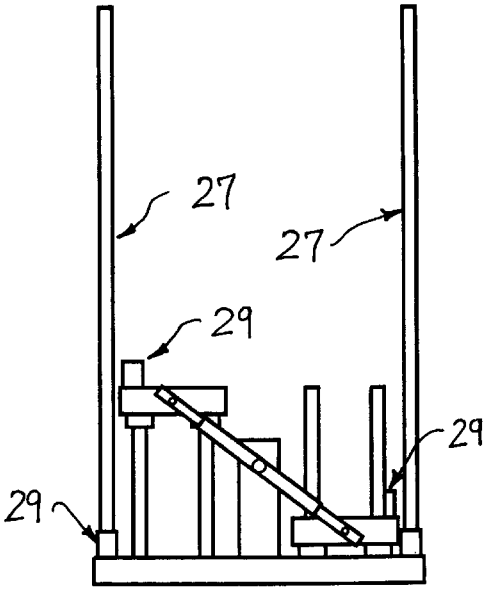
FIG. 6C is a front view of the multistep exercise apparatus utilizing a hand engagement means mounted to the structural frame means.

As mentioned previous, a hand engagement means 25 may be part of the apparatus and may serve different purposes. This is demonstrated in FIGS. 6A through 7C. As seen in FIGS. 6A, 6B, and 6C, the hand engagement means 25 may be a generally inverted U-shaped structure which can be mounted either to the structural frame means 11 or to the foot engaging member 21. Having the hand engagement means 25 mounted to the frame would assist the user in maintaining better balance. Mounting it to the foot engaging member 21 would allow the user to perform upper body workout routines. The hand engagement means 25 may comprise a hand engagement handle 26 with at least one downwardly extending handle support member 27, each having holes 28. Having two handle support members 27 which may prove better. These members may be tubular structures containing holes 28 through the side and located towards the end of each handle support member 27. Also part of the hand engagement means 25 may be handle mounts 29, which also have holes 28 through the side. Handle mounts 29 may also be tubular in design amd may be rigidly mounted on structural frame means 11 along one of the cross support members 13, or may be mounted on the foot engaging members 21, or both.

Figure 6D:
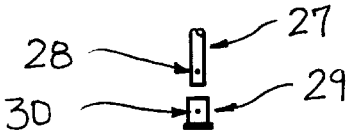
FIG. 6D is a side view of the handle mount used to attach the handle support member to the foot engaging member.

FIG. 6D demonstrates how handle support members 27 mount in handle mount 29. As stated, each end of handle support member 27 contains holes 28 through the side. The handle mount 29 also has holes 28 through the side. Handle mount 29 has a larger diameter than handle support members 27, thereby allowing handle support members 27 to fit within. Once inside, the respective holes 28 are aligned and the members and mounts are secured together through some type of securing means such as a pin or bolt. As stated, when the hand engagement means 25 is mounted to the frame, it is used primarily for balancing purposes. When the hand engagement means is mounted to foot engaging members 21, it may be used primarily for upper body workout. The user will be able to produce downward motion in the foot engaging members 21 with both their feet and hands.

Figure 7B:
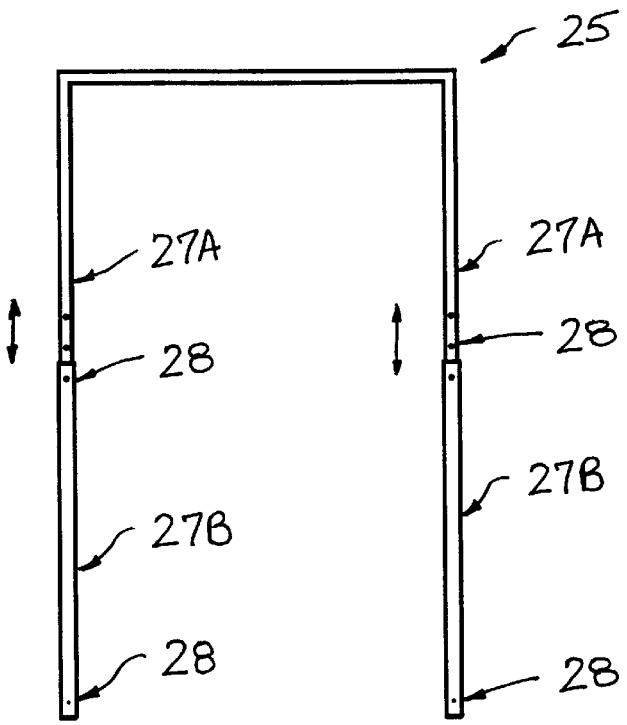
FIG. 7B is a side view of an adjustable hand engagement means.
Figure 7C:
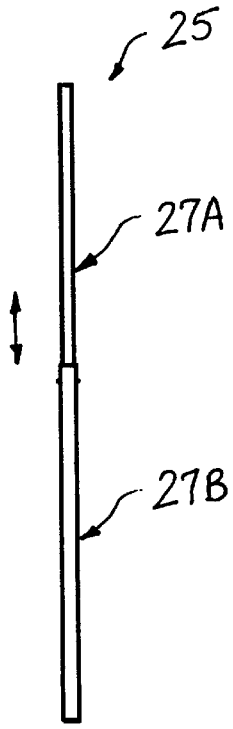
FIG. 7C is a front view of an adjustable hand engagement means.
Figure 7A:
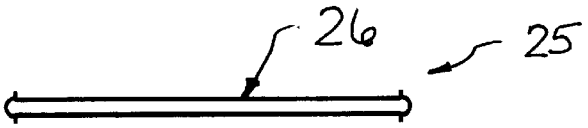
FIG. 7A is a top view of an adjustable hand engagement means.

An additional feature of the hand engagement means 25 may be seen in FIGS. 7A, 7B, and 7C. The handle support members 27 may be composed of two components, 27A and 27B. Component 27A is connected to the hand engagement handle 26 and may be positioned within component 27B, in a telescoping-like manner. Both components 27A and 27B have holes 28 through the side. Component 27A may be positioned at different intervals within components 27B, the holes 28 may then be aligned, and the two components secured together through some type of securing means, such as a pin or bolt. This ability to vertically adjust the hand engagement means 25 allows the device to be easily configured for people of varying heigths.

Figure 8A:
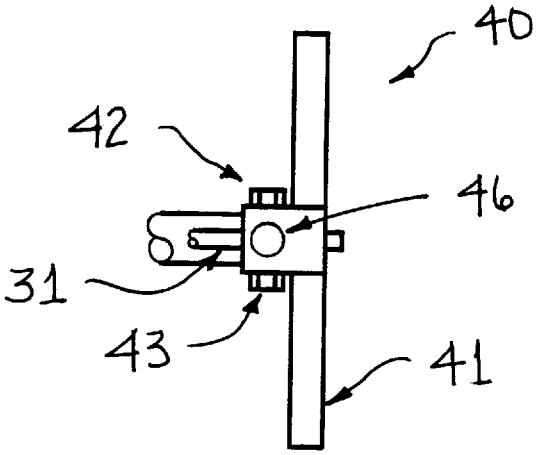
FIG. 8A is a top view of a resistance means which may be used in conjunction with the multistep exercise apparatus.
Figure 8C:
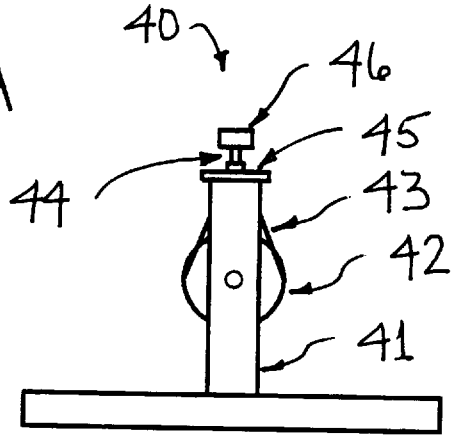
FIG. 8C is a front view of a resistance means which may be used in conjunction with the multistep exercise apparatus.
Figure 8B:
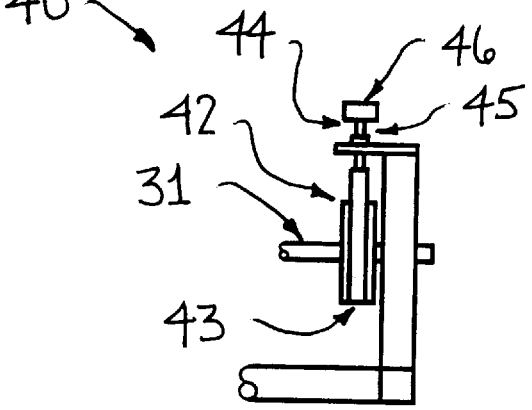
FIG. 8B is a side view of a resistance means which may be used in conjunction with the multistep exercise apparatus.

As mentioned previously, a resistance means may also be part of the apparatus to provide a resistance in the upward and downward movement of foot engaging members 21. The resistance means may be optional because it is possible for the user to utilize their own body for resistance, by having their non-stepping foot act against the upward motion of the foot engaging member 21, and thus against the stepping foot. FIGS. 8A, 8B, and 8C demonstrate a separately connected resistance means 40. As seen, resistance means 40 is a commonly seen type of resistance device and may comprise a resistance mount 41, a circular member 42, a friction belt 43, a threaded shaft 44, a threaded opening 45, and a knob 46. The resistance mount 41 will connect to the structural frame means 11. Resistance mount 41 contains a threaded opening 45 through which a threaded shaft 44 turns. The threaded shaft 44 has a knob 46 fixedly mounted on one end, which is used to turn the threaded shaft. Loosely connected to the other end is a friction belt 43, which does not turn as knob 46 turns. The friction belt 43 may be an endless belt which extends around at least a portion of the periphery of circular member 42. Circular member 42 may be rigidly mounted upon shaft member 31 of the power translating mechanism 30, and will turn simultaneously with shaft member 31. Therefore as the user pushes downward upon the foot engaging member 21, motion will occurr in circular member 42. The amount of force exerted by the friction belt 43 upon circular member 42 will correspond to the amount of resistance encountered by the user as they push downward upon foot engaging member 21. The amount of force exerted by friction belt 43 may be adjusted through knob 46. When the knob is turned in one direction, threaded shaft 44 will turn accordingly and move upward, causing the friction belt 43 to tighten against circular member 42, increasing the resistance force. Upon turning the knob in the other direction, the belt will loosen, thereby decreasing the resistance force.

It is possible to have a resistance means which is part of the power translating mechanism, not a separate component. As seen in FIGS. 5A, 5B, and 5C, the lever connection member 32 and the sliding connectors 34 are very similar in function to an air pump system. The sliding connector 34 is similar to a plunger, and the lever connection member 32 is similar to an air chamber. Air would enter and exit the chamber through an orifice opening. If the assembly was air tight, then as the plunger moves outward, air would be drawn into the chamber. As the plunger moves inward, air would be forced out of the chamber. Resistance to movement would occurr as the air is being forced out of the chamber. The amount of resistance felt could be varied by varying the size of the orifice opening. This type of resistance means is found on some stair-stepper devices.

Figure 9A:
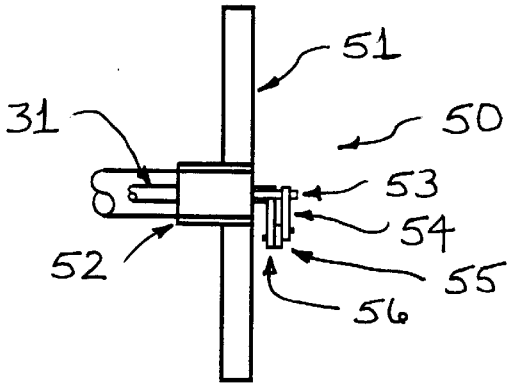
FIG. 9A is a top view of a motor means which may be used in conjunction with the multistep exercise apparatus.
Figure 9C:
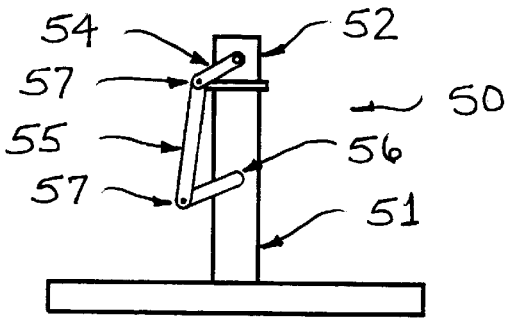
FIG. 9C is a front view of a motor means which may be used in conjunction with the multistep exercise apparatus.
Figure 9B:
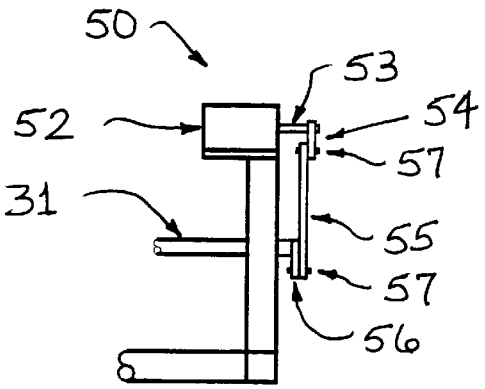
FIG. 9B is a side view of a motor means which may be used in conjunction with the multistep exercise apparatus.

FIGS. 9A, 9B, and 9C demonstrate a motor means 50 which may be used in conjunction with the power translating mechanims 30 to produce automatic motion in the foot engaging members 21. Motor means 50 may comprise a motor mount 51, a motor 52 having a motor shaft 53, and a rocker-crank linkage assembly comprising a crank link 54, coupler link 55, and a rocker link 56. The links may be pivotally connected together using linkage connectors 57. As seen, motor 52 mounts upon motor mount 51, and the crank link 54 is rigidly mounted to motor shaft 53. The rocker link 56 may be rigidly mounted to optional shaft member 31 of power translating mechanism 30, or the rocker link 56 may itself be lever connection member 32. Coupler link 55 connects the crank link 54 and the rocker link 56. Therefore, as motor shaft 53 rotates, so will crank link 54. As crank link 54 rotates, rocker link 56 will rock backward and forward, causing foot engaging members 21 to move correspondingly upward and downward automatically. The degree to which shaft member 31 or lever connection member 32 rotates backward and forward is dependent upon the lengths of the crank, coupler, and rocker links. By altering their lengths or changing the points at which the links are connected together, the user may change the amount of rotation, and thus change the levels to which foot engaging members 21 move upward and downward.

There are many modifications, variations, and alterations which may be made to the apparatus described in this application. Different types of guide members, resistance means, motor means, etc., may be used to provide identical operating functions. Many variations of the power translating mechanism also exists. These include variations in the leverage type system system shown, along with other types of power systems. Examples of different leverage systems include a lever mounted to a shaft member and having end segments which are sleeve-like members pivotally mounted to the end of the foot engaging members. These sleeve-like member will slide upon the lever. Another example is a lever system in which the lever has end segments containing elongated slots through which the foot engaging members loosely mount. The foot engaging member connector slides within these slots. These, along with the lever system described in this specification, are examples of levers having adaptable adjusting end segments pivotally connected to the foot engaging members. Again, the connection points can be at different point locations along the foot engaging members, to prohibit any twisting motion in the members. Other power systems include chain and sprocket type assemblies, and pneumatic or hydraulic type power systems.

While it will be apparent that the preferred embodiment of the invention herein is well-calculated to fulfill the objects above stated, it will be appreciated that the invention is susceptible to modification, variation, and change without departing from its proper scope or fair meaning of the subjoined claims.

I claim:

1. An exercise apparatus comprising:

a structural frame means comprising a rigid frame, a first foot engaging member and a second foot engaging member, both foot engaging members having a front and rear portion;

a power translating mechanism operatively connecting said rigid frame of said stuctural frame means and the front and rear portions of said foot engaging members, such that downward motion in the front portion of each of said foot engaging member produces downward motion in the rear portion of the same said foot engaging member; said power translating mechanism comprising;

a first lever member pivotally mounted to said rigid frame of said structural frame means, said first lever member being pivotally mounted at a generally perpendicular angle to the front portion of said first foot engaging member; a second lever member pivotally mounted to said rigid frame of said structural frame means, said second lever member being pivotally mounted at a generally perpendicular angle to the rear portion of said first foot engaging member; a third lever member pivotally mounted to said rigid frame of said structural frame means, said third lever member being pivotally mounted at a generally perpendicular angle to the front portion of said second foot engaging member; a fourth lever member pivotally mounted to said rigid frame of said structural frame means, said fourth lever member being pivotally mounted at a generally perpendicular angle to the rear portion of said second foot engaging member; a means for rigidly connecting said first and second lever members such that downward motion of said first lever member produces downward movement in said second lever member; and a means for rigidly connecting said third and fourth lever members such that downward motion of said third lever member produces downward movement in said fourth lever member; whereby said foot engaging members are not allowed to pivot significantly in the forward and backward directions;

a force transmitting means for producing an upward force upon each of said foot engaging member, moving said foot engaging members in the upward directions;

whereby the user may perform a forward and backward stepping exercise routine such that the feet of the user move in a substantially vertical direction while maintaining a substantially horizontal position.

2. The exercise apparatus as claimed in claim 1, further comprising guide members rigidly mounted to said rigid frame of said structural frame means, wherein each of said guide member comprises an elongated structure extending in a substantially vertical direction.

3. The exercise apparatus as claimed in claim 2, wherein each of said foot engaging members comprises:

a relatively flat structure upon which a user places a foot while in a standing position; and at least one guide opening extending in a substantially vertical direction through said flat structure for loosely receiving one of said guide members, thereby coupling said foot engaging member to said structural frame means such that said foot engaging member moves in a substantially vertical direction and maintain a substantially horizontal position.

4. The exercise apparatus as claimed in claim 1, said first and third lever members being rigidly connected together, in general alignment with one another, and said second and fourth lever members being rigidly connected together, in general alignment with one another, such that downward movement in said first foot engaging member produces upward movement in said second foot engaging member, and downward movement in said second foot engaging member produces upward movement in said first foot engaging member, thus said force transmitting means for producing upward motion in said first foot engaging member being said second foot engaging member, and said force transmitting means for producing upward motion in said second foot engaging member being said first foot engaging member.

5. The exercise apparatus as claimed in claim 1, said means for rigidly connecting said first and second lever members and for rigidly connecting said third and fourth lever members being a shaft member, said shaft member being pivotally mounted to said rigid frame of said structural frame means.

6. The exercise apparatus as claimed in claim 5, said lever members having end segments, said end segments being adaptable adjustable to compensate for the different vertical positions of said foot engaging members.

7. An exercise apparatus comprising:

a structural frame means comprising a rigid frame, and guide members mounted to said rigid frame, wherein each of said guide members comprises an elongated structure extending in a substantially vertical direction;

two foot engaging members, each foot engaging member having at least two lever members pivotally mounted at a generally perpendicular angle to the foot engaging member, said lever members also being pivotally mounted to said rigid frame of said structural frame means, each of said foot engaging members comprising:

a relatively flat structure upon which a user places a foot while in a standing position; and a means for coupling said foot engaging member to said guide members of said structural frame means such that said foot engaging member moves in a substantially vertical direction;

a force transmitting means for producing an upward force upon each of said foot engaging member, moving said foot engaging members in the upward directions;

whereby the user may perform a forward and backward stepping exercise routine such that the feet of the user move in a substantially vertical direction while maintaining a substantially horizontal position.

8. The apparatus as claimed in claim 7, said means for coupling said foot engaging member to said structural frame means comprising at least one guide opening extending in a substantially vertical direction through said flat structure for loosely receiving one of said guide members, thereby coupling said foot engaging member to said structural frame means.

9. The exercise apparatus as claimed in claim 7, said lever members pivotally coupled to said first foot engaging member and said levers members pivotally coupled to said second foot engaging member being rigidly connected together, in general alignment with one another, such that downward movement in said first foot engaging member produces upward movement in said second foot engaging member, and downward movement in said second foot engaging member produces upward movement in said first foot engaging member, thus said force transmitting means for producing upward motion in said first foot engaging member being said second foot engaging member, and said force transmitting means for producing upward motion in said second foot engaging member being said first foot engaging member.

10. The exercise apparatus as claimed in claim 9, said lever members having end segments, said end segments being adaptable adjustable to compensate for the different vertical positions of said foot engaging members.

11. An exercise apparatus comprising;

a structural frame means comprising a rigid frame; and guide members mounted near the front and rear of said rigid frame, wherein each of said guide members comprises an elongated structure extending in a substantially vertical direction;

a first and second foot engaging members, each foot engaging member having a front and rear portion, and comprising;

a relatively flat structure upon which a user places a foot while in a standing position; a means for coupling the front portion of said foot engaging member to one of said guide members mounted near the front of said structural frame means; and a means for coupling the rear portion of said foot engaging member to one of said guide members mounted near the rear of said structural frame means; whereby said guide members guide said foot engaging member in the substantially vertical direction and enable said foot engaging member to maintain a substantially horizontal position;

a force transmitting means operatively connecting the front portion of said first foot engaging member with the front portion of said rigid frame; a force transmitting means operatively connecting the rear portion of said first foot engaging member with the rear portion of said rigid frame; a force transmitting means operatively connecting the front portion of said second foot engaging member with the front portion of said rigid frame; a force transmitting means operatively connecting the rear portion of said second foot engaging member with the rear portion of said rigid frame;

whereby the user may perform a forward and backward stepping exercise routine such that the feet of the user move in a substantially vertical direction while maintaining a substantially horizontal position.

12. The exercise apparatus as claimed in claim 11, wherein said means for coupling said foot engaging members and said guide members comprises guide openings extending in a substantially vertical direction through said flat structure and loosely receiving one of said guide members, thereby coupling said foot engaging member to said structural frame means such that said foot engaging member maintains a substantially horizontal position while moving in a substantially vertical direction.

13. The exercise apparatus as claimed in claim 11, said force transmitting means being lever members pivotally mounted to said foot engaging members at a generally perpendicular angle, said lever members also being pivotally mounted to said rigid frame of said structural frame means.

14. The exercise apparatus as claimed in claim 13, said lever members pivotally coupled to the front portion of said first foot engaging member and said lever members pivotally coupled to the front portion of said second foot engaging member being rigidly connected together, in general alignment with one another; said lever members pivotally coupled to the rear portion of said first foot engaging member and said levers members pivotally coupled to the rear portion of said second foot engaging member being rigidly connected together, in general alignment with one another, such that downward movement in said first foot engaging member produces upward movement in said second foot engaging member, and downward movement in said second foot engaging member produces upward movement in said first foot engaging member.

15. The exercise apparatus as claimed in claim 13, said lever members connected to said first foot engaging member being rigidly connected together, and in alignment with one another, so that said lever members move simultaneously; and said lever members connected to said second foot engaging members being rigidly connected together, and in alignment with one another, so that said lever members move simultaneous; such that downward motion in the lever members mounted to the front of said foot engaging members produces downward motion in the lever members mounted to the rear of said foot engaging members.

16. The exercise apparatus as claimed in claim 15, said lever member being rigidly connected together by a shaft member, said shaft member being pivotally mounted to said rigid frame of said structural frame means.

17. The exercise apparatus as claimed in claim 16, said lever members having end segments, said end segments being adaptable adjustable to compensate for the different vertical positions of said foot engaging members.

* * * * *